United States Patent [19]

Kopelman

[11] Patent Number: 4,866,859

[45] Date of Patent: Sep. 19, 1989

[54] TRANSDUCERIZED PRESSURIZED HOT-VAPOR SPRAYING DEVICE

[76] Inventor: Robert Z. Kopelman, 121 Fountain Ave., Rockville Centre, N.Y. 11570

[21] Appl. No.: 223,929

[22] Filed: Jul. 25, 1988

[51] Int. Cl.[4] ..... F26B 19/00

[52] U.S. Cl. ..... 34/44; 34/145; 34/48; 38/77.81; 219/362; 128/400

[58] Field of Search ..... 38/77.8, 77.81, 69, 38/1 C; 34/202, 218, 232, 44, 55, 48, 145; 122/4 A; 219/362, 373; 128/400

[56] References Cited

U.S. PATENT DOCUMENTS

| | | | |
|---|---|---|---|
| 2,323,225 | 6/1943 | Ledbetter | 38/77.8 |
| 3,481,689 | 12/1969 | Rosdahl | 21/58 |
| 4,087,495 | 5/1978 | Umehara | 261/81 |
| 4,419,139 | 10/1983 | Nishikawa et al. | 239/102 |

*Primary Examiner*—Henry A. Bennet

[57] ABSTRACT

In a preferred embodiment, a commercial dry-cleaning or pressing apparatus has a perforated horizontal substrate with a heated pressing iron pivotably mounted thereon for lowering onto and pressing a garment positioned on the upper face of the perforated substrate, the perforated horizontal substrate having perforations therein through which water vapor is passed from a mixing chamber in which pressurized outside air is admixed with pressurized water vapor after pressurized water vapor is passed through a vapor-pump-outlet inclusive of a restricted vent of a water-vapor collecting chamber from enclosed water-vapor space thereof, above heated water having a water-vapor producing transducer therein within an enclosed water-containing vessel also enclosing the water-vapor collecting chamber thereabove, with a water-vapor pressurizing pump with an outside-air intake and feeding air into the water-vapor collecting chamber and concurrently pressurizing an outgoing mixture of air and water vapor from the water-vapor collecting chamber, and a water-vapor thermostat within the water-vapor collecting chamber controlling when the water-vapor pressurizing pump turns on and off alternately, and heating elements with a heating-elements thermostat being within water of the water-containing vessel controlling when the heating elements are turned on and off alternately, and water-vapor sealed water-overflow device within the water-containing vessel, the heating element thermostat being adjacent the water-overflow device, and the heating elements, the water-vapor pressurizing pump and the transducer each having separate on-off switches concurrently alternately activatable and deactivatable by the heating-element thermostat, and the water-vapor switch being connected in series with said transducer off-on switch and the heating-element thermostat, and the heating element switch and the transducer switch being connected in parallel to the heating element thermostat, and the water-enclosing vessel receiving water through a conduit from a larger water-heating tank having a water-tank thermostat controlling the temperature of water within the water-tank water.

17 Claims, 2 Drawing Sheets

TRANSDUCERIZED PRESSURIZED HOT-VAPOR SPRAYING DEVICE

PRIOR ART

While there is no relevant prior art, patents located include the Nishikawa et al. U.S. Pat. No. 4,419,139 directed to a transducer nebulizer having a vapor space opening directly through an outlet communicating with outside space, with an air-blower for causing water-vapor to pass outwardly through the outlet, after the blown air first passes over water-containing space not subject to transducer action. The Umehara U.S. Pat. No. 4,087,495 is directed to an ultrasonic air humidifying apparatus, likewise pumping air over water not being subjected to transcducer action, with the air being channelled past the water surface being subjected to transducer action, and thereafter upwardly through an outlet which is directionally manually regulatable. Rosdahl et al. U.S. Pat. No. 3,481,689 discloses a circulated gas forming an aerosol inclusive of vapor from aqueous ethanol subjected to ultrasonic vibration action while passing the gas thereover and thereafter into contact with instruments to be disinfected.

BACKGROUND TO THE INVENTION

Prior to the present invention, there has not existed any device for utilizing ultrasonics to obtain water vapor for pressurized application thereof to a substrate such as clothing being processed, or such as to a person being subjected to a steam bath. Moreover, no device has utilized heating elements in conjunction therewith, apart from other elements for controlling activation and deactivation, pressure and intermixing air and for separately ascertaining and controlling vapor-space temperature and water-temperature of the water being subjected to transducer vibrating action, nor to the advantages thereof.

Heretofore large expenditures of energy have been required for the effecting of steam or vapor for application during pressing or dry-cleaning, or in obtaining sufficient steam for a steam-bath, or a steam iron or the like. Also, because of the large amount of heat to effect a change of water into steam, there has been a considerable and undesirable time delay, awaiting sufficient heat for steam production.

OBJECTS

Accordingly, objects of the present invention include the overcoming of difficulties and problems of the type noted above, together with achieving the new results not heretofore available, for the production of pressurized vapor.

More particularly, an object is to obtain a novel pressing and/or dry-cleaning device or apparatus for pressurized vapor.

Another object is to obtain a novel steam-like iron producable of presurized vapor.

Another object is to obtain a novel steam bath-type sprayer or shower for pressurized vapor.

Another object is to obtain an improved vapor control device producing vapor of improved control in pressure and/or temperature of pressurized vapor.

Another object is to obtain a novel method of producing pressurized vapor and of applying the same to a substrate.

Other objects become apparent from the preceding and following disclosure.

SUMMARY OF THE INVENTION

Broadly the invention is directed to each of a utensile for applying hot vapor to a substrate, and to the method involved in doing so.

The utensile includes the use of a water-reservoir vessel and associated mechanisms, including a water-storage structure having water-storage space therein together with associated enclosed vapor-space. The water-reservoir vessel and its mechanism includes vapor-vent structure which includes a restricted vent adapted to retain a predetermined degree of pressure sufficient for assisting in subsequent forceful driving of pressurized vapor from the restricted vent through conduits serially connected to the restricted vent, and thereafter through a perforated spray plate or nozzle; the apertures in the perforated located at the end of the conduit(s), are sufficiently small also to retain a portion of the predetermined degree of pressurized vapor emitted from the restricted vent, such that water-vapor within the serially-connected conduits emitted from the perforations (apertures) is forcefully sprayed therefrom upon a substrate. Within the water-containing space of the water-reservoir vessel is located a transducer mechanism adapted to produce ultrasonic vibrations within the water sufficiently to produce water-vapor thereabove, and a pumping or air-pressure mechanism is connected to the vapor-space adapted to intake outside air and pump it through the vapor-space to become a mixture of outside air and water vapor thereupon pumped from the space under elevated pressure; there is preferably a manual adjustment for intermittent setting and/or regulating speed of the pump from zero up to a maximum for the pump. Also associated with the water-containing space of the water-reservoir vessel are heating elements adapted to controllably heat the contained water to desired temperature. The air pump includes an on-off switch and variable-speed motor with at-least manually adjustable controls, and the off-on pump switch is controlled by a vapor-space thermostat manually adjustable. The transducer and the heating elements each also have separate off-on switches, each of which are controlled by a water-temperature controlled thermostat located at or near a water outlet, the water outlet being adapted to maintain pressure within the vapor space while permitting water to exit from the water space responsive to additional water being put into the water-reservoir vessel through a water inlet thereto. Electrical-signal leads from the water-temperature thermostat are connected in preferably parallel to the respective off-on switches of the transducer and the heating elements. The off-on switch leads of the vapor-space pump and vapor-space thermostat, are connected in preferably electrical series with the electrical switch leads of the transducer, such that the vapor-space pump and the transducer are activatable to an "on" state solely when concurrently the temperature of the water is at-least up to the minimum temperature set on the water-temperature thermostat while concurrently the vapor temperature of the vapor space is also up to the minimum water-vapor temperature set on the water-vapor thermostat. Accordingly, if either the temperature of the water vapor or of the water drop below the respective settings on the water-vapor thermostat and on the water-temperature thermostat, the signal will not be serially transmitted while one of the serially-positioned switches is in parallel. There preferably is also an outside-air injection inlet into one or more of the serially connected conduits between the restricted vent and the perforated plate, providing pressurized outside air in an adjustable and controlable amount, as an aid to desired tempering or regulating of temperature of the air-water-vapor prior to its forceful emission through and from the apertures of the perforated plate, onto a substrate; preferably the outside-air injection inlet includes a manually adjustable pump in series with a one-way valve such that pressure within the serially connected conduits is restrained against escape or loss through the outside-air injection inlet, and such that the temperature of the water-vapor and air mixture to be ejected through the perforated plate may be manually adjusted to personal preference(s) intermittently. The serially connected conduit(s) between the restricted vent and the perforated plate, may be a rigid conduit structure preferably insulated, or may be a flexible hose, also preferably insulated. The conduit and/or hose is preferably of light-weight heat-resistant plastic or rubber of suitable thickness and durability, and may be any of conventional or desired types available commercially. However, where flexibility is not relevant to the particular embodiment and its intended use, the conduit(s) may be of any desired metal, preferably of a non-rusting commercially available type such as preferably copper tubing. In a further preferred embodiment, the water provided through the water inlet to the water-containing vessel, is conveyed through water conduit(s) from a conventional type hot-water heater of a conventional size much larger than the volume and heating capacity of the water-containing reservoir vessel and its heating elements, such that preheated water may be fed through a manually intermittently regulatable flow-valve from the hot-water heater, in an amount ranging from zero up to any desired flow rate, with the temperature of water in the hot-water heater being adjusted by an intermittently manually adjustable thermostat thereof. There likewise is preferably an intermittently adjustable manual temperature-setting control for the water-temperature thermostat, such that by turning to a low setting, it is virtually turned off, whereas at intermediate or high settings, an activating signal is emitted therefrom because the temperature of the water is less than the setting thereof. Likewise, the switch of the pressure pump is activable by the vapor-space theremostat solely when the temperature of the water-vapor and/or air-water-vapor mixture is at least as high as the setting on the vapor-space thermostat.

In one preferred embodiment, the perforated plate is a perforated ironing board through which the presurrized mixture of air and water-vaper is forcefully emitted upwardly onto clothing being pressed or to be pressed by a commercial pressing lid-iron embodying appropriate heating mechanism of steam or electrical heating elements, pivoted to be pressed downwardly onto an upper face of the clothing or other apparel being pressed or dry-cleaned. The forcefully emitted air and water-vapor mixture is caused to impregnate the clothing garment during the pressing. The actuation of emission of the mixture of air and water vapor under pressure, may be controlled or regulated —i.e. initiated, adjusted, or substantially terminated by the manual control to the pump-speed of the pump combination. Additionally, therte optionally may be an on-off shut-off valve or shut valve for either blocking-off further emissions and/or for venting through an alternate discharge outlet.

In another preferred embodiment, there is a steam-type iron, except that steam is not required, instead receiving the pressurized mixture of hot water-vapor and air through a flexible hose to a hand-iron having a continuing serially-connected conduit space leading to the perforated iron-bottom plate from which the mixture is forcefully ejected onto the upper surface of the clothing to be ironed, i.e. onto the substrate adjacent the perforations. Likewise, the off-on or regulating control may be by regulation of the speed control of the vapor-pressure pump and/or by separate blocking or shunting valve to an alternate outlet.

In another preferred embodiment, the inventive combination is in the nature of a steam-bath shower-head, except that as before, there need not necessarily be steam emitted therefrom, mixture of water vapor and air being emitted under pressure onto the substrate-skin of the body of the person exposed thereto. As with aforementioned embodiments, similar or identical controls may be and preferably used therewith.

The thermostats are adjustable to the temperatures that best suit the particular application and/or embodiment.

It is significant, however, to note that it has been found that the presurized mixture of air and water-vapor emitted at ambient room temperature for the above-noted commercial pressing embodiment, results in pressing of garments equally as satisfactory as those in which the temperature of the emitted mixture of air and water-vapor is sufficiently high as to contain variable amount(s) of steam as a part thereof. This was an unexpected advantageous finding, with regard to the apparatus-combination and method of the present invention, since it had been reasonably assumed that better results would be obtained by use of the high-temperature mixture of air and water-vapor. Therefore, by employment of the various embodiments of the present invention, there is possible considerable saving(s) of otherwise wasted energy together with the cost thereof, particularly on a large commercial-operation basis.

Moreover, by virtue of the water-vapor produced by the transducer, considerably lower temperatures are utilizable to obtain commensurate levels or amounts of water vapor as compared to a system devoid of a transducer relying solely upon the production of water vapor and/or steam as a result solely of the heating thereof. Accordingly, by avoiding the need of steam production, or of excessive steam production, low temperatures are utilizable successfully at considerable savings of energy and considerable cost savings, particularly on a large commercial basis.

In addition, the above-noted preferred controls, including the electrical series arrangements of the electrical leads to the switches of the transducer and of the vapor pump, result in more adequate control of temperature(s) of the emitted mixture of air and water vapor together with making possible easy adjustment of desired temperature and control thereof by the several manual adjustment mechanisms.

Thus, also as a part of this invention, is the method as practiced as above-described, in the one or more embodiments also described above.

The invention may be better understood by making reference to the following Figures.

THE FIGURES

FIG. 1 illustrates symbolically and diagrammatically various elements of a first preferred embodiment, and circuitry thereof, showing the water-containing vessel, the restricted vent and the serially-connected conduit(s) in side-view cross-section, and featuring various components in diagrammatic block-representation.

FIG. 2 illustrates a variation on the embodiment of FIG. 1, as an alternate embodiments, all features being the same except for the serially-connected conduit being shown as a flexible hose in partial cross-sectional cut-away, and the hand-iron conduit portion also shown in partial cut-away cross-section, shown as it would be hand-supported above a substrate (shown in phantom) of a garment to be pressed on an ironing board and support thereof shown in part, the entire figure being a side view.

FIG. 3 illustrates another embodiment the same as that of FIGS. 1 and 2, except as otherwise noted herein below, as a shower-head type embodiment, illustrating the shower-heat type conduit conducting the pressurized mixture of air and water vapor to and through the shower-head apertures and onto the substrate-back of a person (shown in phantom), all shown in side view and the components symbolically, with partial cut-away cross-section for the spraying head.

DETAILED DESCRIPTION

Figure 1:
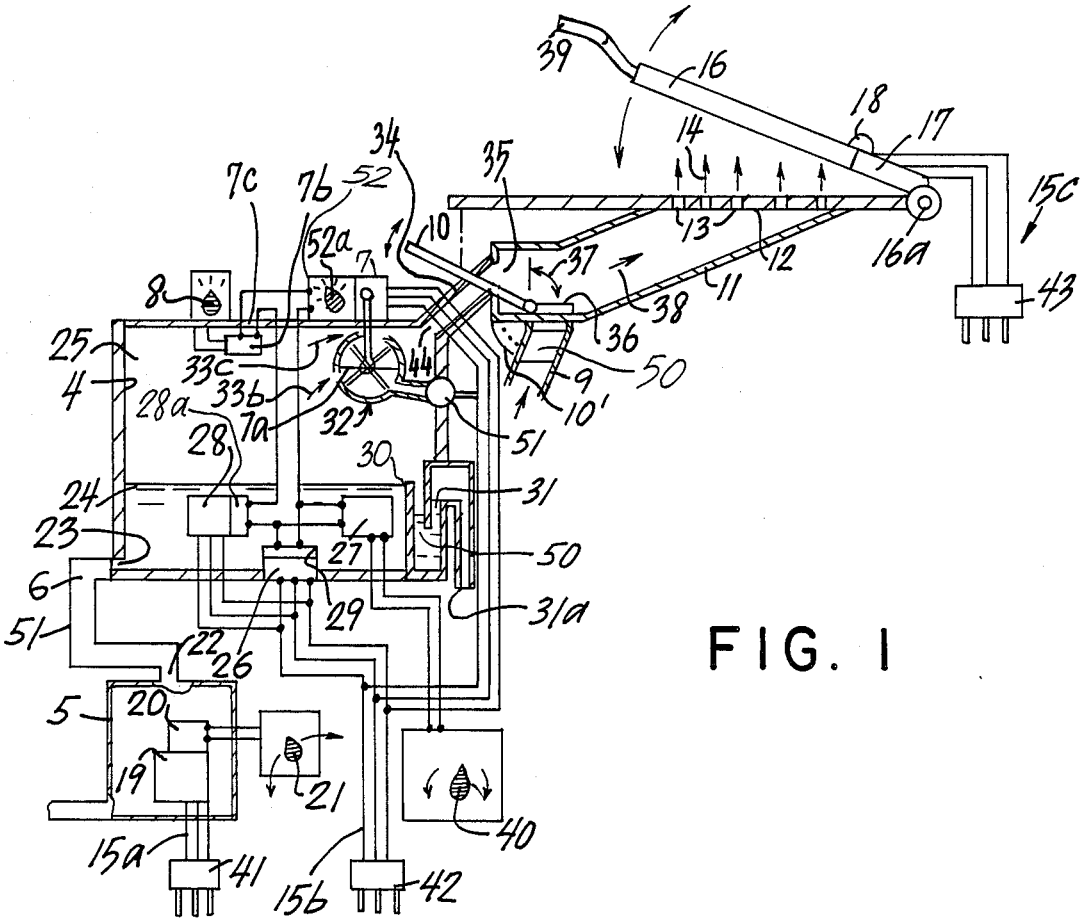
Figure 2:
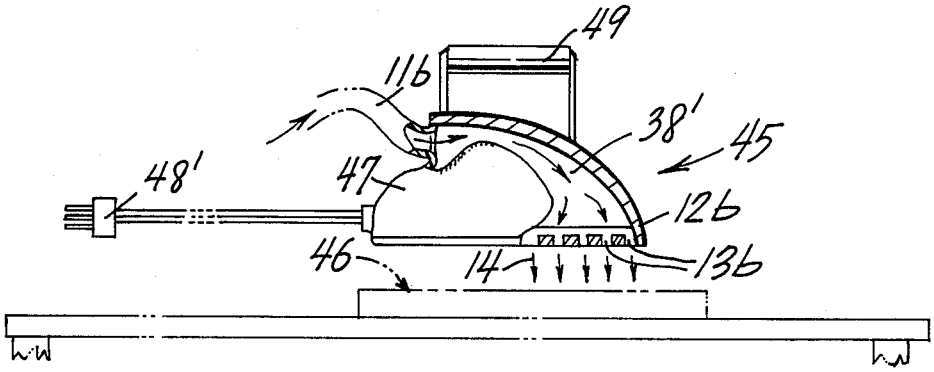
Figure 3:
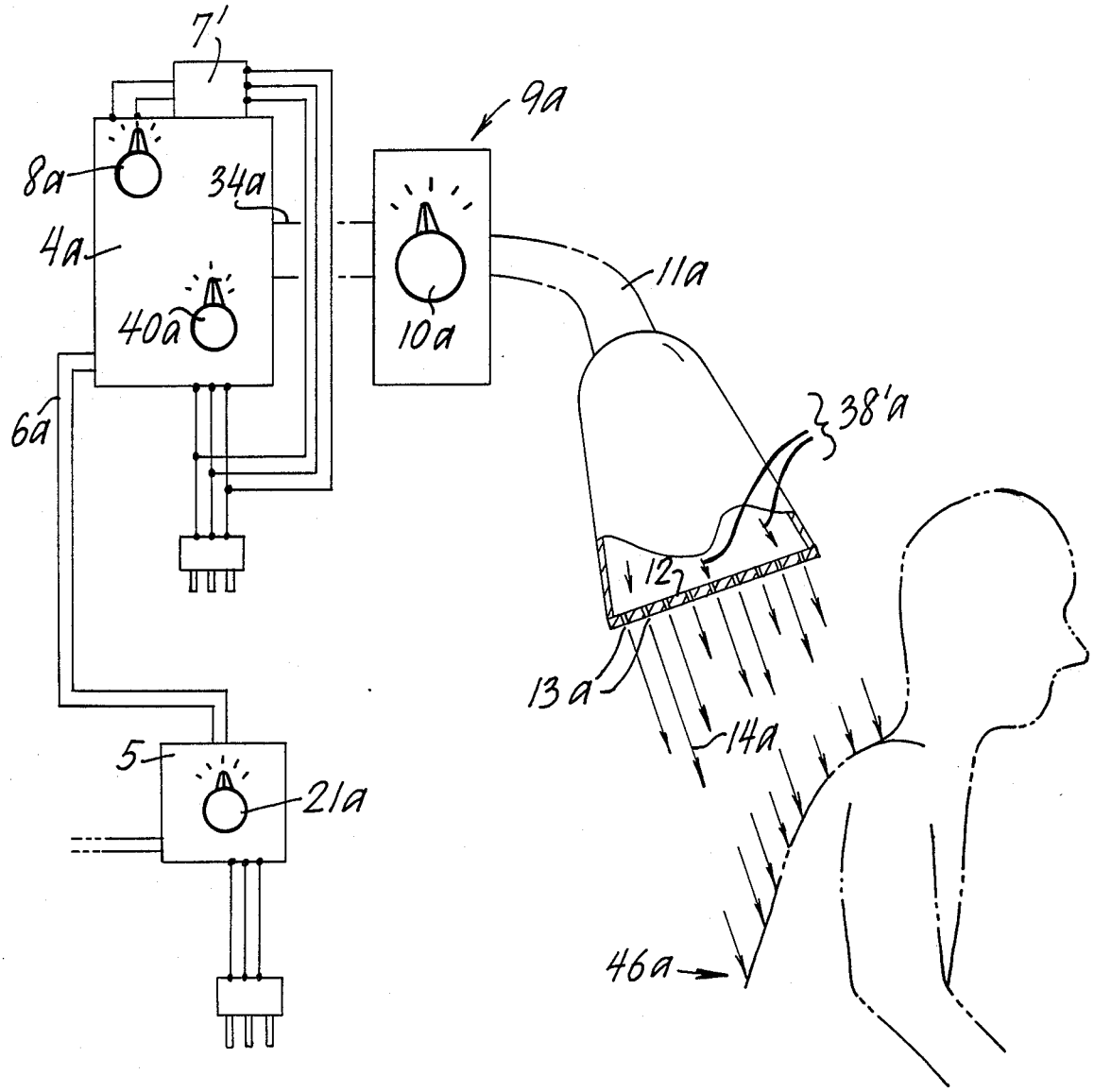

FIGS. 1 through 3 represent substantially the same preferred generic embodiment illustrated in all, but the separate figures representing differeng embodiments for different uses, each of the figures and representations therein being purely symbolic and diagrammatic in nature.

Insofaras elements of the three FIGS. 1 through 3 correspond in nature and function and use, substantially identical or similar indicia are utilized to facilitate understanding. Once a member has been described for one member or element, for one Figure, description thereof is not repeated in other Figures except when done to further facilitate understanding or to elaborate.

Accordingly, FIG. 1 shows a water-containing vessel 4 in side cross-section, to which normally heated water is provided from hot-water heating-tank 5 out of its vent 22 by way of conduit 6 having typically manually controlled valve 51. Gas-impelling pump 7 includes impellers 7*a*, for admixing outside air and for impelling the mixture under pressure through the restricted vent-space 44 of vent or conduit structure 34 into serially-connected conduit 11 that channels the pressurized mixture to the perforated plate 12 through the apertures 13 the as pressurized sprayed-mixture 14 onto a substrate to be placed on top of the plate 12 prior to lowering the pivoted hot-iron lid 16 heated by heating element 18, having hinge structure 17 pivoted at pivot 16*a*. Various typical conventional 3-wire electric cords are represented by 15*a*, 15*b*, and 15*c*. The hot-water tank 5 has the heating elements 19 controlled by the thermostat 20 as setable by its theremostat manual control 21. Water 24 within the water-reservoir vessel 4 has its level controlled by typically an overflow mechanism 30 having a vapor-trap 50 whereby exiting water 31 overflows at point 31 into and from overflow-conduit 31*a*. A partially-enclosing impeller-guide and seal of gas being impelled is shown as impeller-wall 32 forming a space through which the impeller intakes outside air 33*a* from the one-way valve 51 and mixes it with water vapor 33*b* and 33*c* introduced at gaps (breaks) in the impeller-wall 32, eventually all impelled through vent opening 44. Water vapor and mixtures thereof with outside air are caught and stored and fed-from vapor-space 25. Heating elements 26 are controlled by heating-elements switch 29 responsive to alternate activation and deactivation signals from water-temperature theremostat 27. Likewise, the transducer 28 is activatable and deactavatable by its transducer switch 30 responsive to alternate activation signals from the water-temperature thermostat 27. Additionally, however, the transducer switch 30 is connected in electrical series with the switch 52 with its manual controll off-on and speed regulator knob 52 of the pump 7 and the switch 7*c* of the water-vapor thermostat 7*b*, such that until the water-vapor and/or air-mixture thereof in the vapor space is of a temperature at-least as high as the minimal set on the vapor-space thermostat as to thereby close-circuit of that switch, and such that concurrently until the water temperature within the water vessel is of a temperature at least as high as the minimal set on the water-temperature thermostat as to close electrical circuit of the water-temperature thermostat-switch, neither the transducer nor the pressurizing pump will become activated to run (operate), but once both the water-vapor temperature and the water temperature are both at or above the set-minimums of each of the water-temperature thermostat and the water-vapor thermostat, both the transducer and the pressuring pump begin and continue to run (operate) until the temperature of the water or of the water vapor and/or air-mixture thereof fall(s) beneath their separate set values. Therefore, the heating elements 26 begin heating immediately upon activation by signal from the thermostat 27 when water temperature has dropped below the mimimum acceptable preset water-temperature setting. Within air-intake conduit 33 is located a one-way air-valve 51 permitting air to be sucked into air-intake conduit 33 when the pressurizing pumps activated.

Pressurized mixture exits vent-conduit 34 through its outlet port 35 into conduit space 38 of conduit 11, to exit through apertures 13 of plate 12. An optional but preferred additional air-intake conduit 9 has mounted therein air-pump 50 for pumping-in additional cool and/or dry air to be mixed with the pressurized mixture emitted from vent 35, and the manual control 10′ permits intermittent manual regulation of the extent to which the pivotally-mounted door 36 is opened in direction 37. The commercial ironing lid 16 has manual handle 39. The thermostat 27 has the manually-settable knobs for setting the minimum temperature, the minimum temperature being the temperature at which the thermostat send a signal that causes switches 29 and 30 to become activated. Plug 41 symbolically provides electric current to the hot-water heater-elements 19. Plug 42 symbolically provides electric current to the heating elements 26. Plug 43 symbolically provides electric current to the heating elements 18 of the lid 16.

FIG. 2 illustrates diagrammatically a pressurized-vapor mixture-iron 45 having the flexible typically rubber premixture-input conduit 11*b* feeding pressurized mixture into space 38′ of the iron 47, forcing the mixture through apertures 13*b* of plate 12*b* of the iron, as vapor 14′ onto the substrate-article or clothing 46 (shown in phantom) to be pressed. Also illustrated is the iron-handle 49 and the iron electrical plug 48.

FIG. 3 illustrate in block form various elements corresponding to the disclosure and identifications of FIG.

1, additionally showing the conduit 11a (typically metal) having a spray-nozzle conduit mounted in series, with its vapor-space 38a, from which the hot pressurized mixture is ejected through the apertures 13a as ejected pressurized hot mixture 14a onto the back-skin substrate 46a of the person being treated therewith.

The method broadly involves the producing of water-vapor, admixing therewith pressurized air, forcefully driving the mixture of air and water-vapor through a restricted vent, thereby restricting release and flow of the pressurized mixture sufficiently to build-up back-pressure that builds up pressure within the water-vapor space, as to facilitate increasing pressure of the mixture passing through the restricted outlet-vent whereby the mixture passing from the restricted vent is passed under continued pressure through one or more serially arrange and communicating conduits onward through small apertures of a perforated sprayer plate, the apertures being sufficiently small as to retain sufficient elevated pressure for the mixture passing through apertures thereof to be forcefully sprayed onto a substrate spaced from the perforated plate. Other aspects of the method include the initial heating as required to elevate water temperature within a reservoir vessel to a height of a minimum allowable water-temperature and thereafter subjecting the heated water to action of a transducer after the water temperature has reached and as long as the water temperature continues to be at at-least the minimum ascertained temperature desired for a particular application of water-vapor spray. Thereafter, after water-vapor and/or an air-mixture thereof has reach a second predetermined temperature necessary for a particular application or embodiment, as measured in the vapor-space, the pressurizing pump become activated concurrently with the activation of the transducer, producing water-vapor and air-admixture thereof of the desired temperature. Normally and preferably, the set-temperature for activation by the vapor-spacer theremostat and switch thereof, is considerably above that of the water-temperature setting, since the water should normally be at a temperature much hotter prior to activation of the transducer and pressurizing pump, for embodiments where it is desirable for the water vapor and/or air admixture thereof to be heated. After the water and vapor-space temperatures are each sufficiently high, the water-vapor is admixed with air and is pumped under pressure through a sufficiently restricted vent or venturi as to retain a predetermined amount of pressurized state, and the emmited mixture is passed through any optional additional conduits and/or additional air is permitted to be forcefully mixed therewith, followed by forcefully ejecting the pressurized final mixture through apertures (of a plate) of sufficiently small size as to ascertain that mixture ejected from the apertures is forcefully applied to a substrate in juxtaposition to but normally nominally spaced from the apertures. In pressing embodiments, the substate is pressed substantially concurrently with the spraying of the pressurized mixture onto the substrate.

It is within the scope of the invention to make such variations and substitution of equivalents, as would be apparent to a person of ordinary skill.

I claim:

1. A utensil for applying hot vapor to a substrate, comprising in combination: a water-reservoir vessel means providing water-storage structure and water-storage space thereof, and providing vapor-enclosing structure and enclosed vapor-space thereof, and said water-reservoir vessel means including vapor-vent structure forming a restricted vent, the vapor-enclosing structure being such that vapor-pressure within said enclosed vapor-space is maintainable up to a predetermined minimum pressure sufficient to allow pressurized water vapor within to be forcefully vented through said restricted vent forcefully onto a substrate spaced from said restricted vent, and said water-reservoir vessel means being further for providing water to or stored within said water storage space, and said water-reservoir vessel means being further for providing concurrently water-venting and vapor-pressure water vent-sealing means for maintaining said minimum pressure; spray means for directing pressurized hot water vapor of said vapor-space from said restricted vent forcefully onto a substrate to be treated; and water-vapor pressurizing means for producing sufficient pressure forcefully to cause water vapor within said enclosed vapor-space to move through said restricted vent and said spray means onto a substrate to be treated.

2. A utensil for applying hot vapor to a substrate, comprising in combination: a water-reservoir vessel means providing water-storage structure and water-storage space thereof, and providing vapor-enclosing structure and enclosed vapor-space thereof, and said water-reservoir vessel means including vapor-vent structure forming a restricted vent, the vapor-enclosing structure being such that vapor pressure within said enclosed vapor-space is maintainable up to a predetermined minimum pressure sufficient to allow pressurized water vapor within to be forcefully vented through said restricted vent forcefully onto a substrate spaced from said restricted vent, and said water-reservoir vessel means being further for providing water to or stored within said water storage space; spray means for directing pressurized hot water vapor of said vapor-space from said restricted vent forcefully onto a substrate to be treated; water vapor pressurizing means for producing sufficient pressure forcefully to cause water vapor within said enclosed vapor-space to move through said restricted vent and said spray means onto a substrate to be treated; heating means for imparting heat to water within or to be passed into said water-storage space, sufficiently to substantially raise temperature to and substantially maintain temperature within a predetermined range required for obtaining and forcefully venting hot water vapor produced from water stored within the enclosed vapor-space, forcefully from the restricted vent onto a spaced-away substrate to be treated; and transducer activation means for imparting ultrasonic waves to water within said water-reservoir vessel sufficiently to produce water vapor within said enclosed vapor-space, when the transducer means is activated.

3. The utensil of claim 2, in which said transducer means includes a transducer motor and a transducer activation switch therefor alternately responsive to alternate activation and termination signals, to alternately turn-on and turn-off the activation switch of the transducer motor.

4. The utensil of claim 3, including a first thermostat means for detecting temperature of water within said water, and for sending an electrical activation signal to said transducer activation switch whenever temperature of water within said water-reservoir vessel is within said predetermined range, and for terminating the activation signal when temperature of water within said water-reservoir vesssel is below said predetermined range.

5. The utensil of claim 4, in which said water-vapor pressurizing means includes a vapor-pressurizing motor and a pressurizing means switch for alternately turning on and turning off the water-vaporizing motor, and in which said first thermostat means comprises second and third thermostat means, the second thermostat means for sending said activation signal to said transducer activation switch and to said third thermostat means, and said third thermostat means mounted in electrical series with said second thermostat means and said transducer means, for thereby sending said activation signal to said pressurizing means switch, said third thermostat means being set to close electrical circuit to thereby transmit said activation signal when temperature of said water-vapor is up to at least a minimum vapor temperature required for forcefully venting hot water-vapor produced from water stored within the enclosed vapor-space, forcefully from the restricted vent onto a spaced-away substrate to be treated whereby said activating signal reaches said pressurizing means switch only when temperature of said water-vapor is at least up to said minimum water-vapor temperature.

6. The utensil of claim 5, in which said said heating means comprises an electrical heating element mounted and positioned on said water-storage structure such that water stored within said water-storage structure is heatable by said electrical heating element when the electrical heating element is activated.

7. The utensil of claim 6, in which said heating means includes a heating element switch for alternately turning on and turning off said heating element in alternate responses to alternate receipt termination of said activation signal, and in which said second thermostat means is further for sending said activation signal to said electrical heating element for activation thereof, and for deactivating the electrical heating element by termination of said activation signal.

8. The utensil of claim 7, in which said water-vapor pressurizing means includes a one-way gas valve means mounted in a wall of said vapor-enclosing structure, positioned to permitting exterior air pass to said water-vapor pressurizing means and therefrom into said vapor-space such that pressure within said vapor-space is increased when said water-vapor pressurizing means is activated.

9. The utensil of claim 8, in which said spray means includes perforated platform structure including perforation-forming structure forming a plurality of perforations therein positioned such that pressurized vapor from said restricted vent is forced through said plurality of perforations, onto clothing being thereby treated for a pressing thereof.

10. The utensil of claim 9, including a cool-air mixer means for forceably introducing and mixing pressurized air with pressurized vapor vented from said restricted vent, for cooling vented vapor to be forced through said plurality of perforations.

11. The utensil of claim 10, in which said cool-air mixer means includes a manual adjustment means for manually regulating amount of exterior air permitted to be mixed with pressurized vapor vented from said restricted vent.

12. The utensil of claim 11, including manual adjustment means for separately adjusting each of said second and third thermostats and for adjusting speed of said water-vapor pressurizing means such that pressure and temperature of said water vapor within said enclosed vapor-space is regulatable by amount and temperature of exterior air introduced into said enclosed vapor-space.

13. The utensil of claim 12, including hand-iron means for ironing clothing, said spray means being mounted on said hand-iron, positioned to direct vapor from said vapor-space onto clothing being ironed by the hand-iron means.

14. The utensil of claim 13, including a platform-pressing means comprising said perforated platform structure and a heated substantially flat-faced ironing lid pivotally mounted on said perforated platform structure and positioned such that downward pivot thereof onto clothing between said plurality of perforations and said flat-faced ironing lid is effectable of a pressing of clothing therebetween.

15. The utensil of claim 14, in which said spray means and said perforated platform structure thereof form a steam-bath shower-head positioned and directed to spray heated pressurized vapor emitted from said plurality of perforations onto a person's skin spaced therefrom.

16. The utensil of claim 6, and 15, in which said heating means includes an exterior hot-water heating tank means comprising heating elements thereof, for heating water and feeding heated water into said water-storage space.

17. A utensil for applying hot vapor to a substrate, comprising in combination: a water-reservoir vessel means providing water-storage structure and water-storage space thereof, and providing vapor-enclosing structure and enclosed vapor-space thereof, and said water-reservoir vessel means including vapor-vent structure forming a restricted vent, the vapor-enclosing structure being such that vapor-pressure within said enclosed vapor-space is maintainable up to a predetermined minimum pressure sufficient to allow pressurized water vapor within to be forcefully vented through said restricted vent forcefully onto a substrate spaced-from said restricted vent, and said water-reservoir vessel means being further for providing water to or stored within said water storage space, and said water-reservoir vessel means being further for providing concurrently water-venting and vapor-pressure water vent-sealing means for maintaining said minimum pressure; spray means for directing pressurized hot water vapor of said vapor-space from said restricted vent forcefully onto a substrate to be treated; water-vapor pressurizing means for producing sufficient pressure forcefully to cause water vapor within said enclosed vapor-space to move through said restricted vent and said spray means onto a substrate to be treated, heating means for imparting heat to water within or to be passed into said water-storage space, sufficiently to substantially raise temperature to and substantially maintain temperature within a predetermined range required for obtaining and forcefully venting hot water-vapor produced from water stored within the enclosed vapor-space, forcefully from the restricted vent onto a spaced-away substrate to be treated; and transducer means for imparting ultrasonic waves to water within said water-reservoir vessel sufficiently to produce water vapor within said enclosed vapor-space, when the transducer means is activated.

* * * * *